US007466299B2

(12) United States Patent
Kasai et al.

(10) Patent No.: US 7,466,299 B2
(45) Date of Patent: Dec. 16, 2008

(54) DISPLAY DEVICE

(75) Inventors: Naruhiko Kasai, Yokohama (JP); Takehide Furukawa, Yokohama (JP); Hajime Akimoto, Kokubunji (JP); Mitsuhide Miyamoto, Kokubunji (JP)

(73) Assignee: Hitachi Displays, Ltd., Chiba (JP)

( * ) Notice: Subject to any disclaimer, the term of this patent is extended or adjusted under 35 U.S.C. 154(b) by 587 days.

(21) Appl. No.: 10/936,571

(22) Filed: Sep. 9, 2004

(65) Prior Publication Data

US 2005/0083281 A1 Apr. 21, 2005

(30) Foreign Application Priority Data

Oct. 17, 2003 (JP) ..... 2003-358263

(51) Int. Cl.
*G09G 3/36* (2006.01)

(52) U.S. Cl. ..... 345/100; 345/87; 345/88; 345/204; 345/205

(58) Field of Classification Search ..... 345/100, 345/87, 88, 204–205
See application file for complete search history.

(56) References Cited

U.S. PATENT DOCUMENTS

| | | | | |
|---|---|---|---|---|
| 6,256,024 | B1 * | 7/2001 | Maekawa | 345/205 |
| 6,333,737 | B1 * | 12/2001 | Nakajima | 345/205 |
| 2002/0126108 | A1 | 9/2002 | Koyama et al. | |
| 2002/0194558 | A1 * | 12/2002 | Wang et al. | 714/718 |

* cited by examiner

*Primary Examiner*—Richard Hjerpe
*Assistant Examiner*—Leonid Shapiro
(74) *Attorney, Agent, or Firm*—Mattingly, Stanger, Malur & Brundidge, PC

(57) ABSTRACT

A memory integrated type display device is provided which can simplify the circuit structure and suppress consumption power. The display device has a liquid crystal pixel unit having a plurality of display elements disposed in a matrix shape, a horizontal shift register for applying a voltage to the liquid crystal pixel unit, a digital/analog conversion unit, an amplifier, a scanning line drive unit for selecting scan lines in a vertical direction and a memory for storing display data, the memory being electrically connected between the amplifier and liquid crystal pixel unit.

21 Claims, 10 Drawing Sheets

DISPLAY DEVICE

INCORPORATION BY REFERENCE

The present application claims priority from Japanese application JP2003-358263 filed on Oct. 17, 2003, the content of which is hereby incorporated by reference into this application.

BACKGROUND OF THE INVENTION

The present invention relates to a display device having a driver circuit for applying voltage to display elements and a memory for temporarily storing display data, and more particularly to a display device which forms peripheral circuits such as a driver circuit and a memory by using low temperature polysilicon transistors formed on a glass substrate.

JP-A-2002-91332 (corresponding U.S. 2002/0126108A published on Sep. 12, 2002) describes a memory for storing still images formed on a glass substrate on which a display device is formed, and a conventional memory built-in driver formed on the glass substrate.

SUMMARY OF THE INVENTION

According to the above-described background techniques, when a write operation to a memory is executed, an address is required to be designated so that a control circuit is necessary. In a low temperature polysilicon liquid crystal display whose peripheral circuits are formed on a glass substrate, among others, display elements and peripheral circuits are formed on the same glass substrate. Therefore, an increased circuit scale results in an increase in a frame area (i.e., non-display area) of the glass substrate excepting the display area.

An object of the present invention is to suppress an increase in the scale of circuits formed on a liquid crystal display substrate, and more particularly to provide a liquid crystal display having a memory capacity reduction structure.

The present invention has the following aspects in order to solve the above-described issue. According to the first aspect, a memory on a glass substrate is connected between a data line drive circuit and a liquid crystal pixel unit having a plurality of display elements disposed in a matrix shape. According to the second aspect, the memory is connected to the back stage of the liquid crystal pixel unit having a plurality of display elements disposed in the matrix shape via data lines of the display elements. According to the third aspect, an output of the memory in the configuration of the second aspect is connected to another display device different from the display elements.

In the first aspect, an address control for data read and write relative to the memory is not necessary so that peripheral circuits can be simplified. In the second aspect, in addition to the functions of the first aspect, since data read from the memory is displayed on the liquid crystal pixel unit without involvement of the data line drive unit, a consumption power can be suppressed. In the third aspect, in addition to the functions of the second aspect, data read from the memory can be displayed on another display device, e.g, on a subsidiary display screen of a portable telephone.

Other objects, features and advantages of the invention will become apparent from the following description of the embodiments of the invention taken in conjunction with the accompanying drawings.

DETAILED DESCRIPTION OF THE EMBODIMENTS

Embodiments of the invention will be described in detail with reference to the accompanying drawings.

First Embodiment

Figure 1:
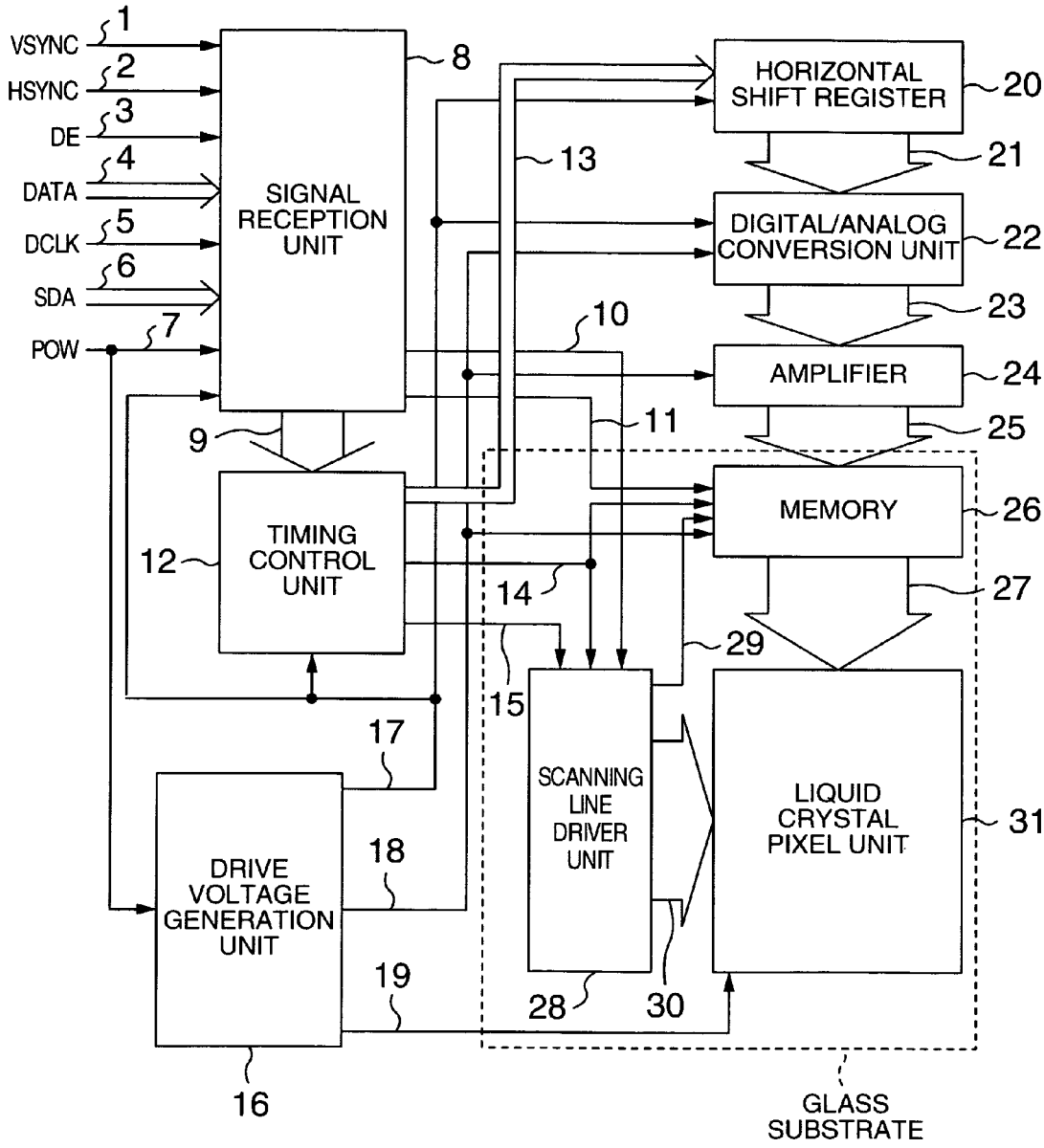
FIG. 1 is a block diagram showing a memory integrated type display device according to a first embodiment of the present invention.

FIG. 1 shows an example of a memory integrated type liquid crystal display device according to the first embodiment of the invention. In FIG. 1, reference numeral 1 represents a vertical synchronizing signal, reference numeral 2 represents a horizontal synchronizing signal, reference numeral 3 represents a data enable signal, reference numeral 4 represents display data, reference numeral 5 represents a synchronizing clock, reference numeral 6 represents a parameter control signal, and reference numeral 7 represents a system power source. The horizontal synchronizing signal 2 is used for synchronizing one horizontal period and the data enable signal 3 is used for indicating an effective time duration of the display data 4, these signals being input synchronously with the synchronizing clock 5.

In this embodiment, the display data 4 is sequentially transferred starting from the upper left pixel on the screen in a raster scan method. In the following description, it is assumed that one pixel data is constituted of 6-bit tonal data. The parameter control signal 6 is a signal for setting and changing parameters of operation modes and timings of the memory integrated type display device of this embodiment. The system power source 7 is supplied from a system apparatus such as a portable telephone and an information terminal using the liquid crystal display device.

In this embodiment, the parameter control signal 6 is a signal having a plurality of bits serially transferred synchronously with the clock (this signal is hereinafter called a "clock synchronized serial interface"). In the following description, it is assumed that the system power source supplies a voltage of, e.g., 1.8 V.

Reference numeral 8 represents a signal reception unit, reference numeral 9 represents reception display data, reference numeral 10 represents memory position information, and reference numeral 11 represents an operation mode signal. The signal reception unit 8 converts the display data 4 having the same voltage amplitude as that of the system power source 7 and other signals, into signals having the same voltage amplitude as that of an operation voltage of the circuits in the display device, by using a panel logic power supply 17. The signal reception unit 8 outputs, as the reception display data 9, the converted signals and control signals based upon the parameter control signal 6.

By using the parameter control signal 6, the signal reception unit 8 also generates the memory position information 10 which is representative of the position on a display screen of data stored in a memory 26, and the operation mode signal 11 indicating whether the operation is a normal display operation or a display operation using the memory.

Reference numeral 12 represents a timing control unit, reference numeral 13 represents a horizontal display control signal which contains the display data and timing signal, reference numeral 14 represents a vertical shift clock, and reference numeral 15 represents a vertical start pulse. By using the reception display data 9, the timing control unit 12 generates the horizontal display control signal 13 for making a horizontal shift register 20 to sample the display data, and the vertical shift clock 14 and vertical start pulse 15 for scanning and controlling write lines of a liquid crystal pixel unit 31.

Reference numeral 16 represents a drive voltage generation unit, reference numeral 17 represents the panel logic power supply, reference numeral 18 represents a liquid crystal driving analog power supply, and reference numeral 19 represents a liquid crystal command electrode power supply. By using the system power source 7 input from the system as a reference, the drive voltage generation unit 16 generates the panel logic power supply 17 for operating logic circuits in the display device, the liquid crystal driving analog power supply 18 for applying voltage to each pixel of the liquid crystal display, and the liquid crystal common electrode power supply 19 for applying voltage to the common electrode of the liquid crystal display. In the following description, it is assumed that all logic circuits in the display device operate at 5 V and the panel logic power supply 17 applies voltage of 5 V.

Reference numeral 20 represents the horizontal shift register, and reference numeral 21 represents horizontal display digital data. In accordance with the horizontal display control signal 13, the horizontal shift register 20 fetches display data of one horizontal line and thereafter outputs it as the horizontal display digital data 21.

Reference numeral 22 represents a digital/analog conversion unit, and reference numeral 23 represents horizontal display analog data. The digital/analog conversion unit 22 converts the horizontal display digital data 21 of one horizontal line into the horizontal display analog data 23 and outputs it, in response to a digital/analog conversion clock (not shown).

Reference numeral 24 represents an amplifier for driving data lines, and reference numeral 25 represents horizontal display data. The amplifier 24 amplifies the analog voltage of the horizontal display analog data 23 and outputs it as the horizontal display data 25 in order to write the data to data lines of the liquid crystal pixel unit 31.

Reference numeral 26 represents the memory, and reference numeral 27 represents horizontal display pixel data. The memory 26 together with the liquid crystal pixel unit 31 is disposed on a glass substrate. The memory 26 performs three operations: storing the horizontal display data 25 in response to a memory vertical start pulse 29; reading the stored data in response to the vertical shift clock 14 and memory vertical start pulse 29 and outputting it as the horizontal display pixel data 27; and outputting the horizontal display data 25 itself as the horizontal display pixel data 27 passing through the memory.

Reference numeral 28 represents a scanning line driver unit for driving scanning lines, reference numeral 29 represents the memory vertical start pulse, and reference numeral 30 represents a vertical scanning signal. The scanning line driver unit 28 generates the vertical scanning signal 30 for sequentially scanning horizontal lines of the pixel unit, in accordance with the vertical shift clock 14 and vertical start pulse 15, and when data read from the memory 26 is to be displayed, the scanning line driver unit 28 generates the memory vertical start pulse 29 matching the horizontal line position along which the read data is displayed.

In this embodiment, a liquid crystal pixel unit 31 is constituted of a plurality of active matrix type liquid crystal pixels disposed on a glass substrate in a matrix shape like a conventional display unit. In the following description, it is assumed that the horizontal display pixel data 27 is written in pixels on a horizontal line selected by the vertical scanning signal 30, and that 240 pixels are arranged in a horizontal direction and 320 lines are arranged in a vertical direction. Although it is preferable that all components shown in FIG. 1 are fabricated on one glass substrate as a module, at least the liquid crystal pixel unit 31, drive unit LSI 28 and memory 26 which are enclosed by a dotted line may be fabricated on one glass substrate.

Figure 2:
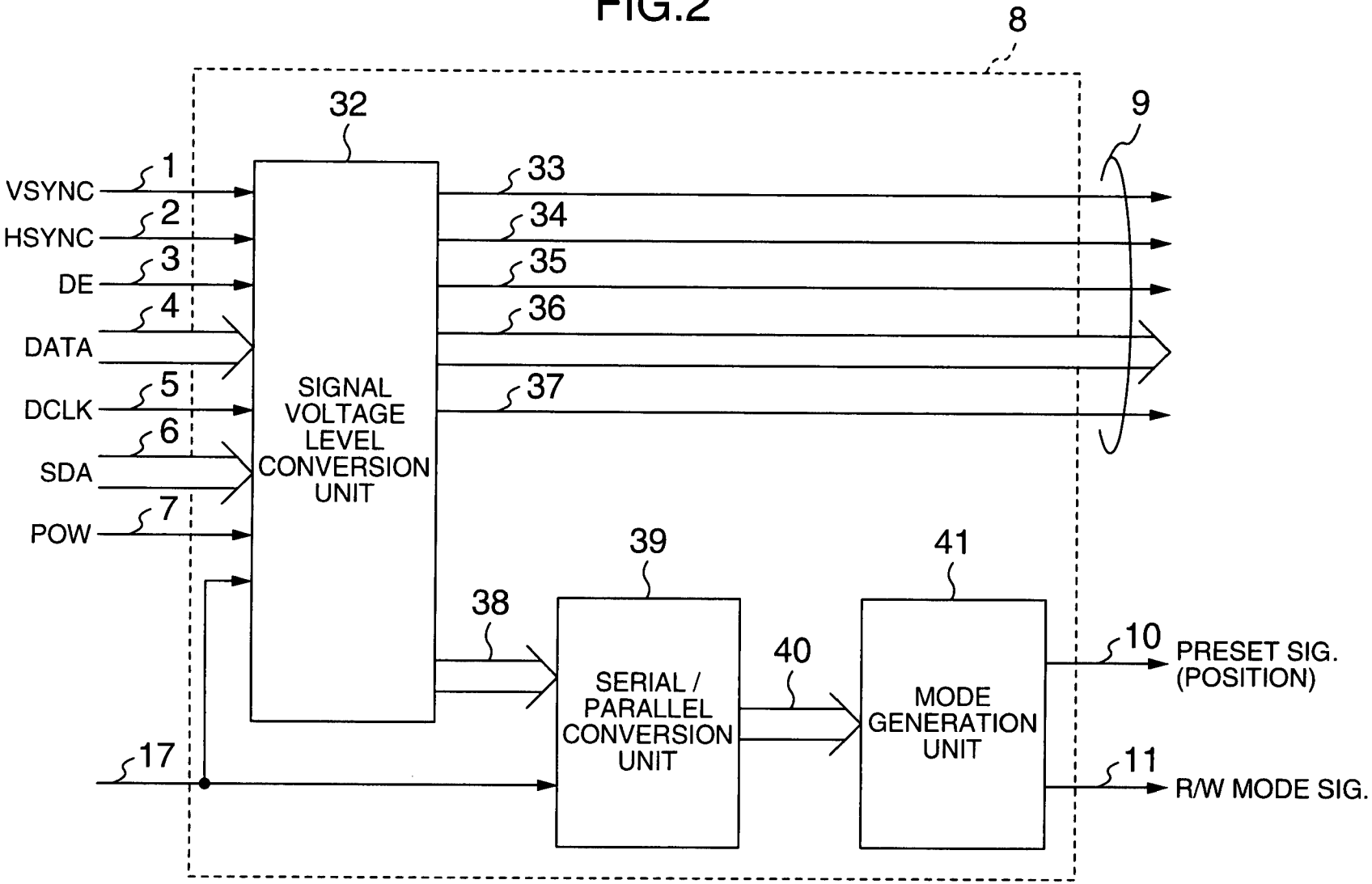
FIG. 2 is a diagram showing the internal structure of a timing controller 8 shown in FIG. 1 according to an embodiment.

FIG. 2 shows an illustration of the internal structure of the signal reception unit 8 shown in FIG. 1. In FIG. 2, reference numeral 32 represents a signal voltage level converter unit, reference numeral 33 represents an internal vertical synchronizing signal, reference numeral 34 represents an internal horizontal synchronizing signal, reference numeral 35 represents an internal display enable signal, reference numeral 36 represent internal display data, reference numeral 37 represents an internal synchronizing clock, and reference numeral 38 represents an internal parameter control signal. The signal voltage level conversion unit 32 converts the vertical synchronizing signal 1, horizontal synchronizing signal 2, data enable signal 3, display data 4, synchronizing clock 5 and parameter control signal 6 respectively having the voltage level of the system power source 7, into the internal vertical synchronizing signal 33, internal horizontal synchronizing signal 34, internal data enable signal 35, internal display data 36, internal synchronizing clock 37 and internal parameter control signal 38 respectively having the voltage level of the panel logic power supply 17, and outputs them.

Reference numeral 39 represents a serial/parallel conversion unit, and reference numeral 40 represents a control parameter. In order to set and change the parameters of the operation mode and timing of the liquid crystal display device, the serial/parallel conversion unit 39 converts the clock synchronizing serial interface having data of a plurality bits serially transferred synchronously with the clock, into parallel data of the control parameter 40 constituted of data and an address of a plurality of bits.

A mode generation unit 41 judges the type of the control parameter 40 from the address in the control parameter 40, and judges the data following the address as the value of the parameter. The control parameter 40 has the operation mode signal 11 indicating a normal display mode or a mode of displaying data stored in the memory, and the memory position information 10 indicating that data at which position on the display screen is stored in the memory or that data read from the memory is displayed at which position on the display screen. In the following description, it is assumed that the operation mode signal 11 has two bits and outputs one of three mode signals representative of "normal display", "memory write" and "memory read" and that the memory position information 10 has two bits and outputs a display start position in the form of a signal indicating one of "upper end", "center" and "lower end" on the display screen.

Figure 3:
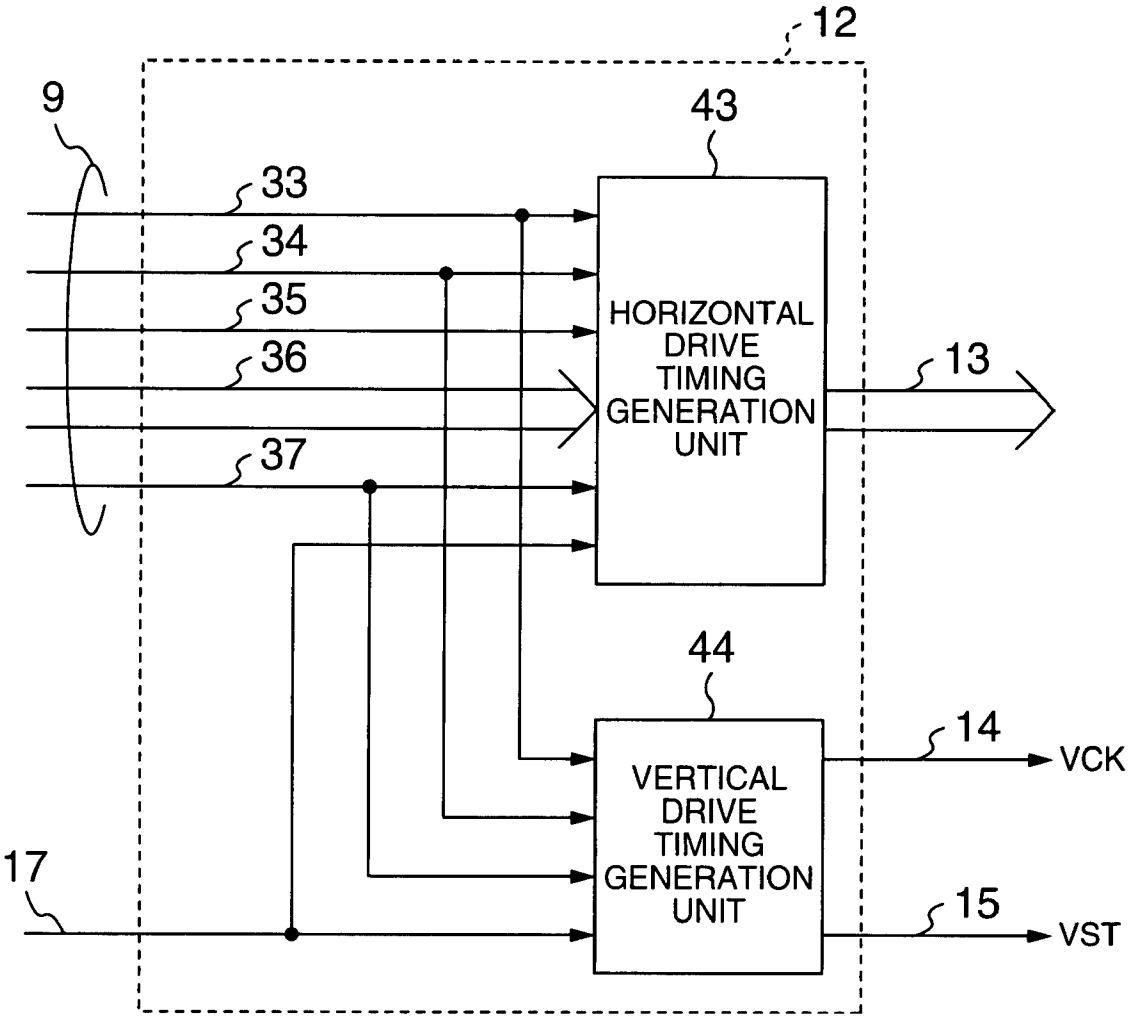
FIG. 3 is a diagram showing the internal structure of a timing controller 12 shown in FIG. 1 according to an embodiment.

FIG. 3 shows an illustration of the internal structure of the timing control unit 12 shown in FIG. 1. In FIG. 3, reference numeral 43 represents a horizontal drive timing signal generation unit, and reference numeral 44 represents a vertical drive timing signal generation unit. By using the internal vertical synchronizing signal 33, internal horizontal synchronizing signal 34, internal data enable signal 35, internal display data 36, and internal synchronizing clock 37, the horizontal drive timing generation unit 43 generates the horizontal display control signal 13 for controlling horizontal direction driving, similar to a conventional manner.

By using the internal vertical synchronizing signal 33, internal horizontal synchronizing signal 34 and internal synchronizing clock 37, the vertical drive timing generation unit 44 generates the vertical shift clock 14 and vertical start pulse 15 for controlling vertical direction driving, similar to a conventional manner.

Figure 4:
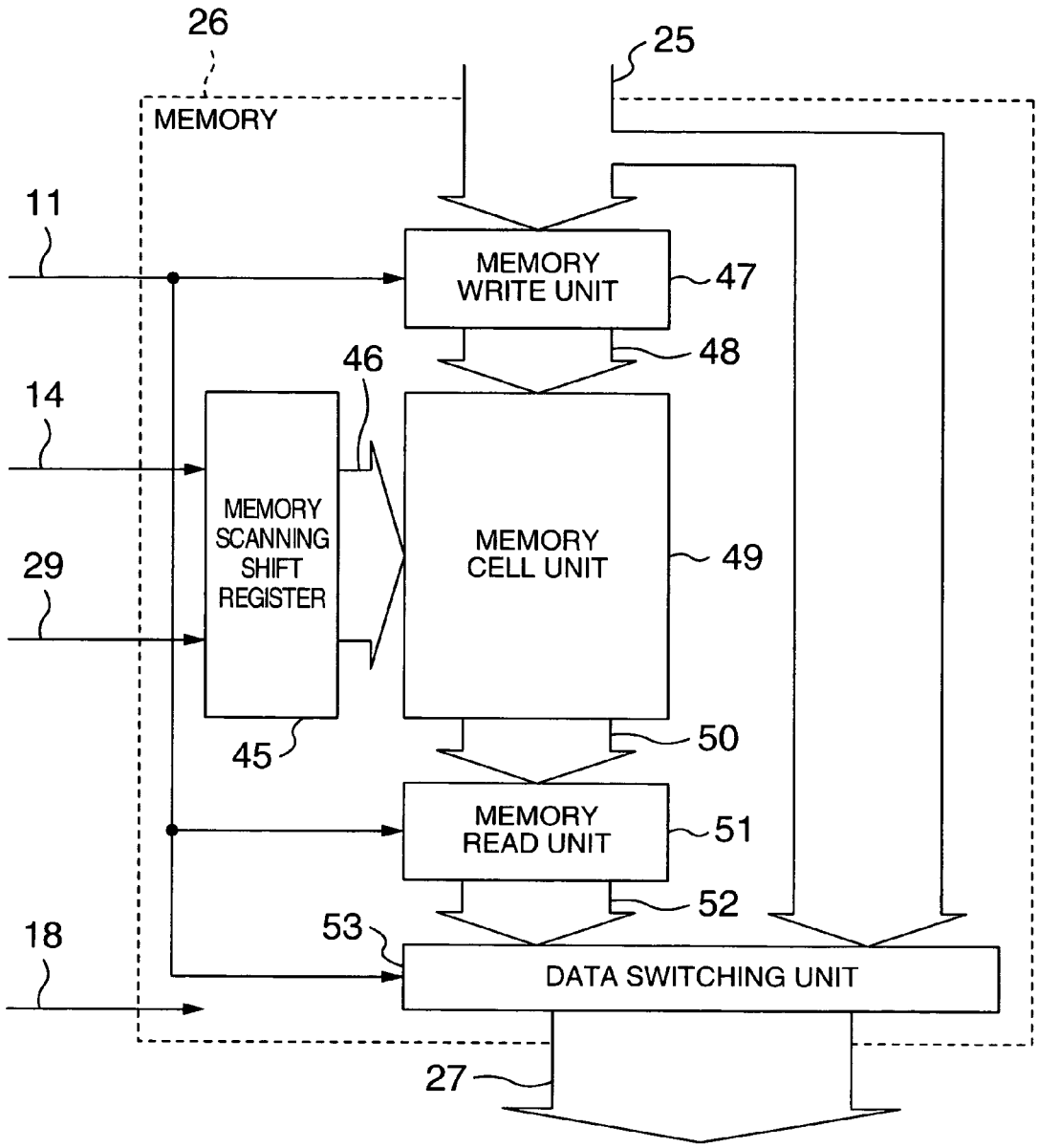
FIG. 4 is a diagram showing the internal structure of a memory 26 shown in FIG. 1 according to an embodiment.

FIG. 4 shows an illustration of the internal structure of the memory 26 shown in FIG. 1. In FIG. 4, reference numeral 45 represents a memory scanning shift register, reference numeral 46 represents a memory scanning signal, reference numeral 47 represents a memory write unit, reference numeral 48 represents memory write data, reference numeral 49 represents a memory cell unit, reference numeral 50 represents memory read data, reference numeral 51 represents a memory read unit (sense amplifier), reference numeral 52 represents memory read data, and reference numeral 53 represents a data switching unit.

The memory scanning shift register 45 generates a memory scanning signal 46 for selecting a horizontal line for data read or write from or to the memory cell unit 49 having memory cells disposed in a matrix shape. The memory write unit 47 outputs the horizontal display data 25 as the memory write data 48 if the operation mode signal 11 indicates the "memory write" operation.

The memory write data 48 is written in the memory cell unit 49 at the horizontal line selected by the memory scanning signal 46.

The memory read unit 51 reads the data on the horizontal line selected by the memory scanning signal 46 from the memory and outputs it as the memory read data 52 if the operation mode signal 11 indicates the "memory read" operation.

The data switching unit 53 selects the horizontal display data 25 from the amplifier 24 if the operation mode signal 11 indicates the "normal display" operation, selects the memory read data 52 from the memory cell unit 49 if the operation mode signal 11 indicates the "memory read" operation, and outputs the selected data as the horizontal display pixel data 27.

In the following description, it is assumed that the memory cell unit 49 has 240×40 dots which is a portion of 240×320 dots of the liquid crystal pixel unit 31, and analog data input to each dot is stored as one-bit information indicating whether the data is larger or smaller than a threshold value, and that one bit is assigned to each color for color information to display eight colors.

Figure 5:
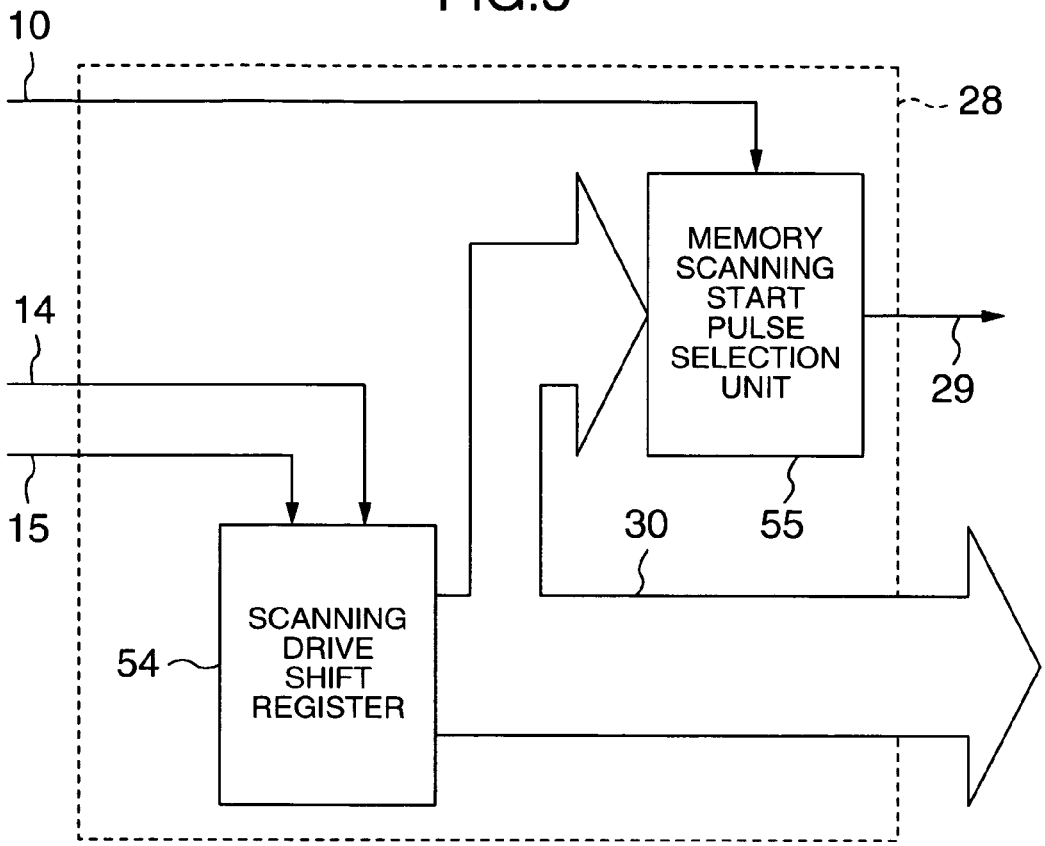
FIG. 5 is a diagram showing the internal structure of a scanning line driver 28 shown in FIG. 1 according to an embodiment.

FIG. 5 shows an example of the internal structure of the scanning line driver unit 28 shown in FIG. 1. In FIG. 5, reference numeral 54 represents a scanning drive shift register, and reference numeral 55 represents a memory scanning start pulse selection unit. Similar to a scanning drive shift register of a conventional liquid crystal display device, the scanning drive shift register 54 sequentially shifts the vertical start pulse 15 one stage after another in response to the vertical shift clock 14 and outputs the vertical scanning signal 30 which selects one vertical scanning line.

The memory scanning start pulse selection unit 55 selects only a pulse at the position indicated by the memory position information 10 from selection pulses of the vertical scanning signal 30, and outputs it as the memory vertical start pulse 29.

Figure 6:
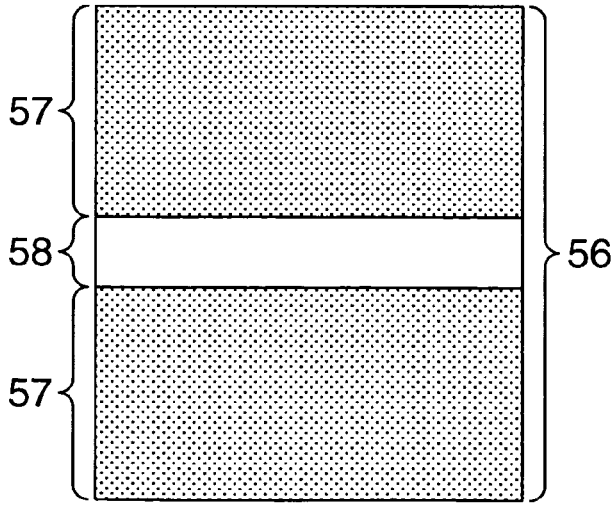
FIG. 6 is a diagram showing the state of a display screen during a "memory read" mode of the operation mode according to the invention.

FIG. 6 is a diagram showing the state of the display screen during the "memory read" mode among the operation modes of the present invention. Reference numeral 56 represents a whole display area, reference numeral 57 represents non-display areas during the "memory read" mode, and reference numeral 58 represents a display area during the "memory read" mode. The memory read display area 58 corresponds to an area of 240×40 which is the capacity of the memory cell unit 49, and the position of the display area is one of the "upper end", "center" and "lower end" on the display screen selected by the memory vertical start pulse 29 designated by the memory position information 10. The area other than the display area is the memory read mode non-display area 57, the whole display area 56 being constituted of the non-display area or areas and the display area.

Figure 7:
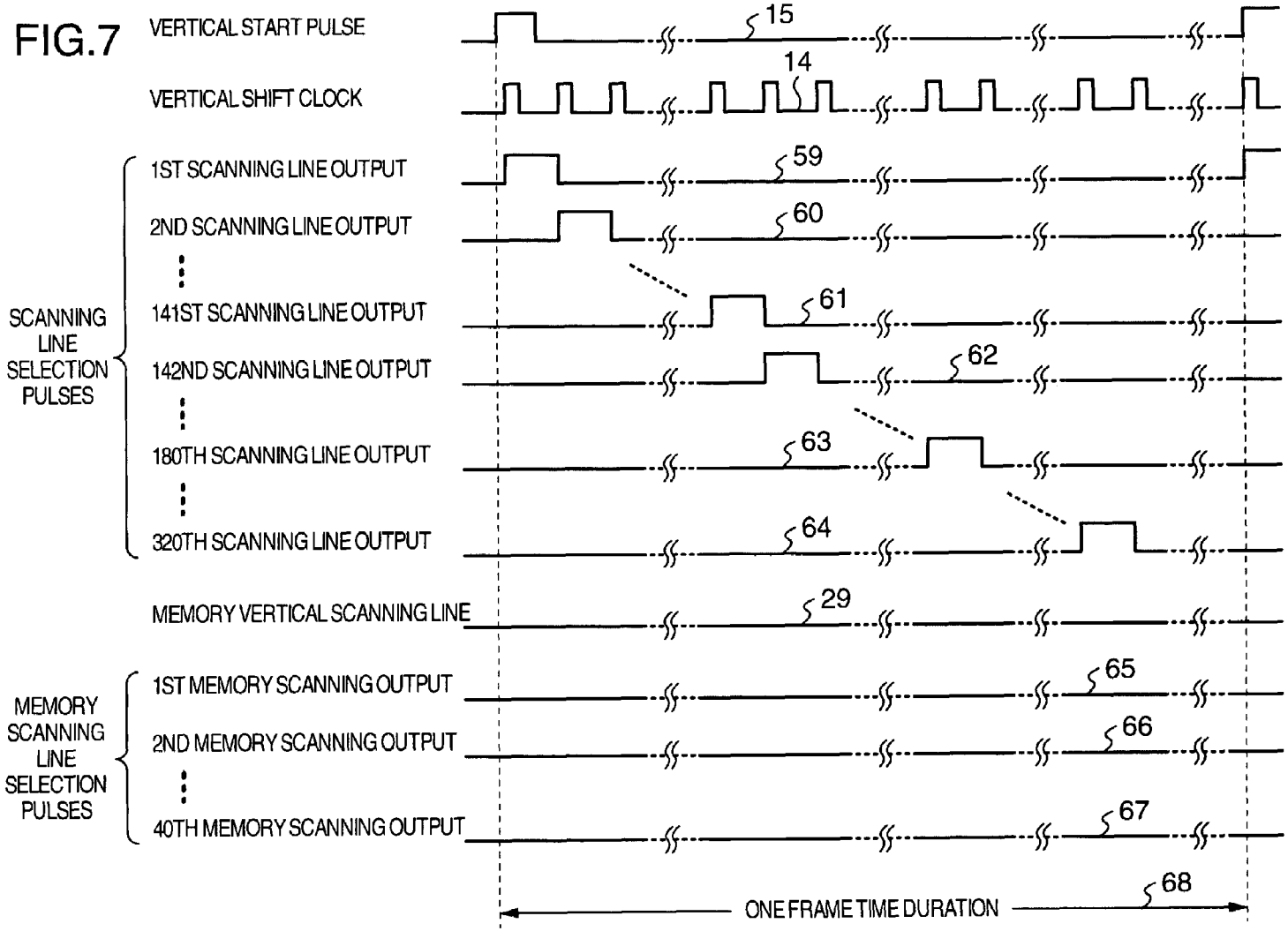
FIG. 7 is a diagram illustrating the operations of a scan driving shift register 54 and a memory scan start pulse selector 55 shown in FIG. 5 during a "normal display" operation mode.

FIG. 7 illustrates the operations of the scanning drive shift register 54 and memory scanning start pulse selection unit 55 shown in FIG. 5 during the normal display operation mode. Reference numeral 59 represents a 1st scanning line output of a scanning line selection pulse, reference numeral 60 represents a 2nd scanning line output of the scanning line selection pulse, reference numeral 61 represents a 141st scanning line output of the scanning line selection pulse, reference numeral 62 represents a 142nd second scanning line output of the scanning line selection pulse, reference numeral 63 represents a 180th scanning line output of the scanning line selection pulse, and reference numeral 64 represents a 320th scanning line output of the scanning line selection pulse.

As shown, the scanning line selection pulses 59 to 64 are output by making the vertical start pulse 15 sequentially shift in response to the vertical shift clock 14.

Reference numeral 65 represents a 1st scanning line output of a memory scanning line selection pulse in the normal display mode, reference numeral 66 represents a 2nd scanning line output of the memory scanning line selection pulse in the normal display mode, and reference numeral 67 represents a 40th scanning line output of the memory scanning line selection pulse in the normal display mode.

As shown, since the memory scanning line selection pulses 65 to 67 in the normal display mode are used in the operation mode not using the memory, no pulse is output. Reference numeral 68 represents one frame time duration, and as shown, the scanning line selection pulses 59 to 64 constitute one period in the one frame time duration 68.

Figure 8:
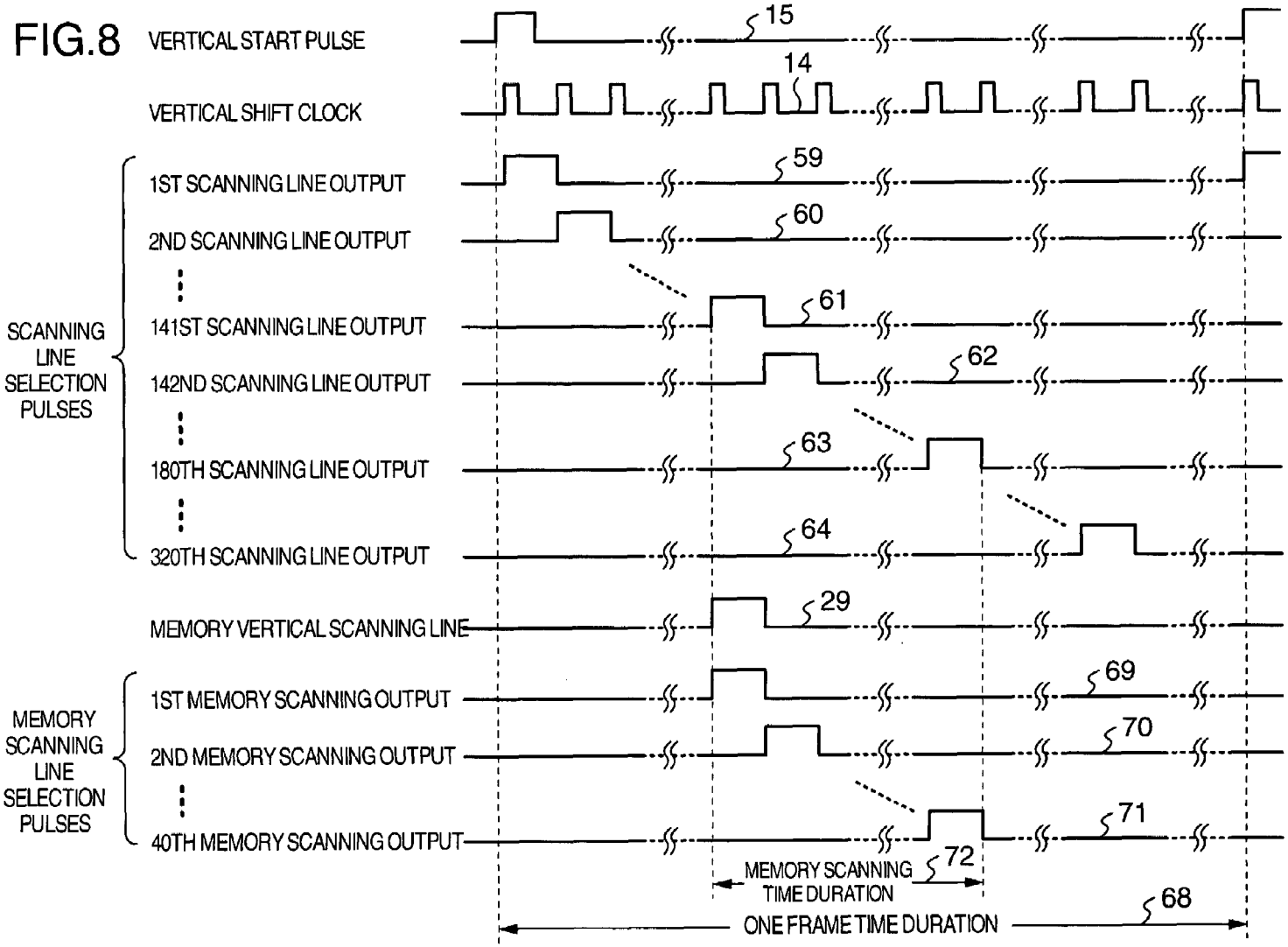
FIG. 8 is a diagram illustrating the operations of the scan driving shift register 54 and memory scan start pulse selector 55 shown in FIG. 5 during a "memory read" mode.

FIGS. 8 is a diagram illustrating the operations of the scanning drive shift register 54 and memory scanning start pulse selection unit 55 shown in FIG. 5 in the memory write operation mode and memory read operation mode, i.e., during the memory operation. Reference numeral 69 represents the 1st scanning line output of the memory scanning line selection pulse during the memory operation, reference numeral 70 represents the 2nd scanning line output of the memory scanning line selection pulse during the memory operation, and reference numeral 71 represents the 40th scanning line output of the memory scanning line selection pulse during the memory operation. Reference numeral 72 represents a memory scanning time duration. The memory scanning line selection pulses 69 to 71 during the memory operation are output by making a "1" output of the memory vertical start pulse 29 sequentially shift in response to the vertical shift clock 14.

The memory vertical start pulse 29 outputs "1" when the scanning selection pulse corresponding to the same scanning line position as the memory scanning start position outputs "1", in accordance with the memory position information 10 indicating that data at which position on the display screen is stored in the memory or that data read from the memory is displayed at which position on the display screen.

Assuming that the memory position information 10 indicates the "center" on the display screen, the memory vertical start pulse 29 becomes "1" when the 141st scanning line output of the scanning line selection pulse becomes "1". Therefore, during the memory write, the memory scanning line selection pulses 69 to 71 are output during the memory scanning time duration 72 at the same timings as the timings of the scanning line selection pulses 61 to 63 of the display 141st line to 180th line.

In the following, with reference to FIGS. 1 to 8, the memory control of the memory integrated display device of this embodiment will be described. First, with reference to FIG. 1, a flow of display data will be described.

Referring to FIG. 1, the signal reception unit 8 performs level conversion of the input signals having an amplitude of 1.8 V and including the vertical synchronizing signal 1, horizontal synchronizing signal 2, data enable signal 3, display data 4, synchronizing clock 5, and parameter control signal 6, to change the level to the same amplitude as the panel logic power supply 17, and outputs necessary signals as the reception display data 9.

By using the parameter control signal 6, the signal reception unit 8 generates the operation mode signal 11 and the memory position information 10. The operation mode signal 11 is representative of three operation modes including the "normal display" for performing a normal display, the "memory write" for writing data to the memory and the "memory read" (also called "partial display) for displaying data read from the memory by stopping data transfer from the system during power saving. The memory position information 10 indicates which data on the display screen of the liquid crystal pixel unit 31 is stored in the memory, and indicates data at which position on the display screen is displayed in the "memory read".

By using the level converted reception display data 9, the timing control unit 12 generates the horizontal display control signal 13 for controlling the timing in the horizontal direction and the vertical shift clock 14 and vertical start pulse 15 for controlling the timings in the vertical direction.

Similar to a conventional liquid crystal display device, by using the system power source 7, the drive voltage generation unit 16 generates the panel logic power supply 17 for operating logic circuits in the panel, the liquid crystal drive analog power supply 18 used as a reference of the voltage to be applied to the liquid crystal, and the liquid crystal common electrode power supply 19 for applying voltage to the command electrode.

The horizontal shift register 20 latches data of one horizontal line in response to the horizontal display control signal 13 and outputs the data to the horizontal display digital data 21, similar to a conventional manner.

The digital/analog conversion unit 22 converts the horizontal display digital data 21 into analog data to be applied to the liquid crystal and outputs it to the horizontal display analog data 23, similar to a conventional manner.

The amplifier 24 amplifies the horizontal display analog data 23 in order to write it to the liquid crystal pixel unit, and outputs it as the horizontal display data 25, similar to a conventional manner.

Similar to a conventional manner, the scanning line drive unit 28 sequentially shifts the vertical start pulse 15 in response to the vertical shift clock 14 and outputs it as the vertical scanning signal 30, and outputs the memory vertical start pulse 29 used as the memory write start pulse and memory read start pulse in accordance with the memory position information 10 indicating the memory write start position and memory read start position.

Similar to a conventional manner, the liquid crystal pixel unit 31 writes voltage output as the horizontal display pixel data 27 to the pixels on the horizontal line selected by the scanning line signal 30 to display the display data.

With reference to FIG. 2, description will be made on the details of the operation of the signal reception unit 8 shown in FIG. 1. First, the voltage level conversion of the input signals will be described. Referring to FIG. 2, the signal voltage level conversion unit 32 performs level conversion of the input signals having an amplitude of 1.8 V and including the vertical synchronizing signal 1, horizontal synchronizing signal 2, data enable signal 3, display data 4, synchronizing clock 5, and parameter control signal 6, by using the 1.8 V system power source and 5 V panel logic power supply 17, and outputs them as the internal vertical synchronizing signal 33, internal horizontal synchronizing signal 34, internal data enable signal 35, internal display data 36, internal synchronizing clock 37, and internal parameter control signal 38 respectively having an amplitude of 5 V.

Although the 5 V panel logic power supply is used, the voltage is not limited only thereto. If the panel logic power supply has the same voltage as that of the system power source, the signal voltage conversion unit 32 can be omitted.

Next, description will be made on the details of the operation of judging from the parameter control signal 6 the control parameter such as the operation mode. Referring to FIG. 2, the serial/parallel conversion unit 39 converts the clock synchronizing serial interface which serially transfers the address of a plurality of bits and data, into the parallel control parameter 40 constituted of the address of a plurality of bits and data.

The mode generation unit 41 judges from the address of the control parameter 40 the meaning of the following data, and generates the mode signal from the data.

The address discriminates between the operation mode and the memory position information. For example, if the address is "0", the following data is data representative of the operation mode. If the data is "0", it is judged as the "normal display", if it is "1", it is judged as the "memory write", and if it is "2", it is judged as the "memory write" respectively to output as the operation mode signal 11.

If the address is "1", the following data is the data representative of the memory position information. It is judged that if it is "0", data of 40 lines in the "upper end" on the display screen is stored and displayed, if it is "1", data of 40 lines in the "center" on the display screen is stored and displayed, and if it is "2", data of 40 lines in the "lower end" is stored and displayed, respectively to output them as the memory position information 10.

The parameter is not limited to those described above, but it is obvious that the types of addresses may be increased to perform a variety of control operations.

With reference to FIG. 3, description will be made on the details of the timing generation operation of the timing control unit 12 shown in FIG. 1. This operation is similar to the operation of a conventional liquid crystal display device. Referring to FIG. 2, the horizontal drive timing generation unit 43 generates the timing signal for controlling the horizontal direction drive from the internal vertical synchronizing signal 33, internal horizontal synchronizing signal 34, internal data enable signal 35, and internal synchronizing clock 37 respectively shifted to the internal logic voltage level, adjusts the timing of the internal display data 36 by using the timing signal, and outputs the timing signal and internal display data 36 as the horizontal display control signal 13. The vertical drive timing generation unit 44 generates the vertical shift clock 14 and vertical start pulse 15 for controlling the vertical direction drive by using the internal vertical synchronizing signal 33, internal horizontal synchronizing signal 34 and internal synchronizing clock 37.

With reference to FIGS. 4 to 8, description will be made on the details of the memory control operation of the memory 26 and vertical drive unit 28 shown in FIG. 1. First, with reference to FIG. 4, the details of the memory control operation of the memory 26 will be described.

Referring to FIG. 4, the memory scanning shift register 45 sequentially shifts the memory vertical start pulse 29 in response to the vertical shift clock 14 to output the memory scanning signal 46.

The memory write unit 47 outputs the horizontal display data 25 as the memory write data 48 if the operation mode signal 11 indicates the "memory write".

The memory write data 48 is written in cells of the memory cell unit 49 on a horizontal line selected by the memory scanning signal 46.

If the operation mode signal 11 indicates the "memory read", the memory read unit 51 reads the memory read data 50 from cells of the memory cell unit 49 on a horizontal line selected by the memory scanning signal 46, and outputs it as the memory read pixel data 52.

If the operation mode signal 11 indicates the "normal display", the data switching unit 53 selects the horizontal display data 25, and if the operation mode signal 11 indicates the "memory read", it selects the memory read data 52, respectively to output them as the horizontal display pixel data 27.

Next, with reference to FIGS. 5 to 8, description will be made on the details of memory scanning by the scanning line drive unit 28. Referring to FIG. 5, similar to a conventional manner, the scanning drive shift register 54 sequentially shifts the vertical start pulse 15 in response to the vertical shift clock 14 and outputs it as the vertical scanning signal 30. In accordance with the memory position information 10, the scanning start pulse selection unit 55 selects the position of the scanning drive signal 30 corresponding to the position of the memory at which data is written or read, and outputs it to the memory vertical start pulse 29.

Referring to FIG. 6, the position representative of the display area 58 in the memory read mode is sent as the memory position information 10. In this case, the memory position information 10 is "1" indicating the "center" on the display screen.

Referring to FIG. 7 illustrating the operation in the "normal display" mode, the vertical start pulse 15 is sequentially shifted in response to the vertical shift clock 14 to output the 1st scanning line output 59 of the scanning line selection pulse, 2nd scanning line output 60 of the scanning line selection pulse, . . . , 141st scanning line output 61 of the scanning line selection pulse, 142nd second scanning line output 62 of the scanning line selection pulse, . . . , 180th scanning line output 63 of the scanning line selection pulse, . . . , and 320th scanning line output 64 of the scanning line selection pulse, in this order recited. Since the operation mode is the "normal display" mode, the signals of the memory vertical start pulse 29 and following pulses are not output.

Referring to FIG. 8 illustrating the operation in the "memory read display" mode, similar to the "normal display" mode, the vertical start pulse 15 is sequentially shifted in response to the vertical shift clock 14 to output the 1st scanning line output 59 of the scanning line selection pulse, 2nd scanning line output 60 of the scanning line selection pulse, . . . , 141st scanning line output 61 of the scanning line selection pulse, 142nd second scanning line output 62 of the scanning line selection pulse, . . . , 180th scanning line output 63 of the scanning line selection pulse, . . . , and 320th scanning line output 64 of the scanning line selection pulse, in this order recited.

In the "memory read display" mode, one of the outputs from the 1st scanning line output to the 320th scanning line output of the scanning line selection pulses is selected and output in accordance with the memory position information 10. In this example, since the memory position information 10 indicates the "center" on the display screen, display data starting from the 141st line is written in the memory and the read data is displayed on the lines starting from the 141st line. Therefore, the 141th scanning line output 61 of the scanning line selection pulse is selected and output as the memory vertical start pulse 29.

The memory vertical start pulse 29 is sequentially shifted in response to the vertical shift clock 14 to output the 1st scanning line output 69 of the memory scanning line selection pulse, 2nd scanning line output 70 of the memory scanning line selection pulse, . . . , and 40th scanning line output 71 of the memory scanning line selection pulse, in this order recited.

In the manner described above, the control of the memory write operation and memory read operation using the memory built in the liquid crystal display panel can be realized. The present invention does not limit the capacity of the memory as in the embodiment, but the memory may have the capacity corresponding to the whole display area, or the memory use area during the power saving mode may be limited by the parameter control. In either case, the control can be simplified by connecting the memory 26 between the amplifier 24 and liquid crystal pixel unit 31.

According to the first embodiment of the present invention, the horizontal display data 25 is written in the memory cell unit 49 through the scanning line selection control by the memory scanning shift register 45 so that a complicated address control is not necessary and in particular, the circuit scale wherein a memory is formed on a glass substrate can be suppressed from becoming large.

Second Embodiment

Figure 9:
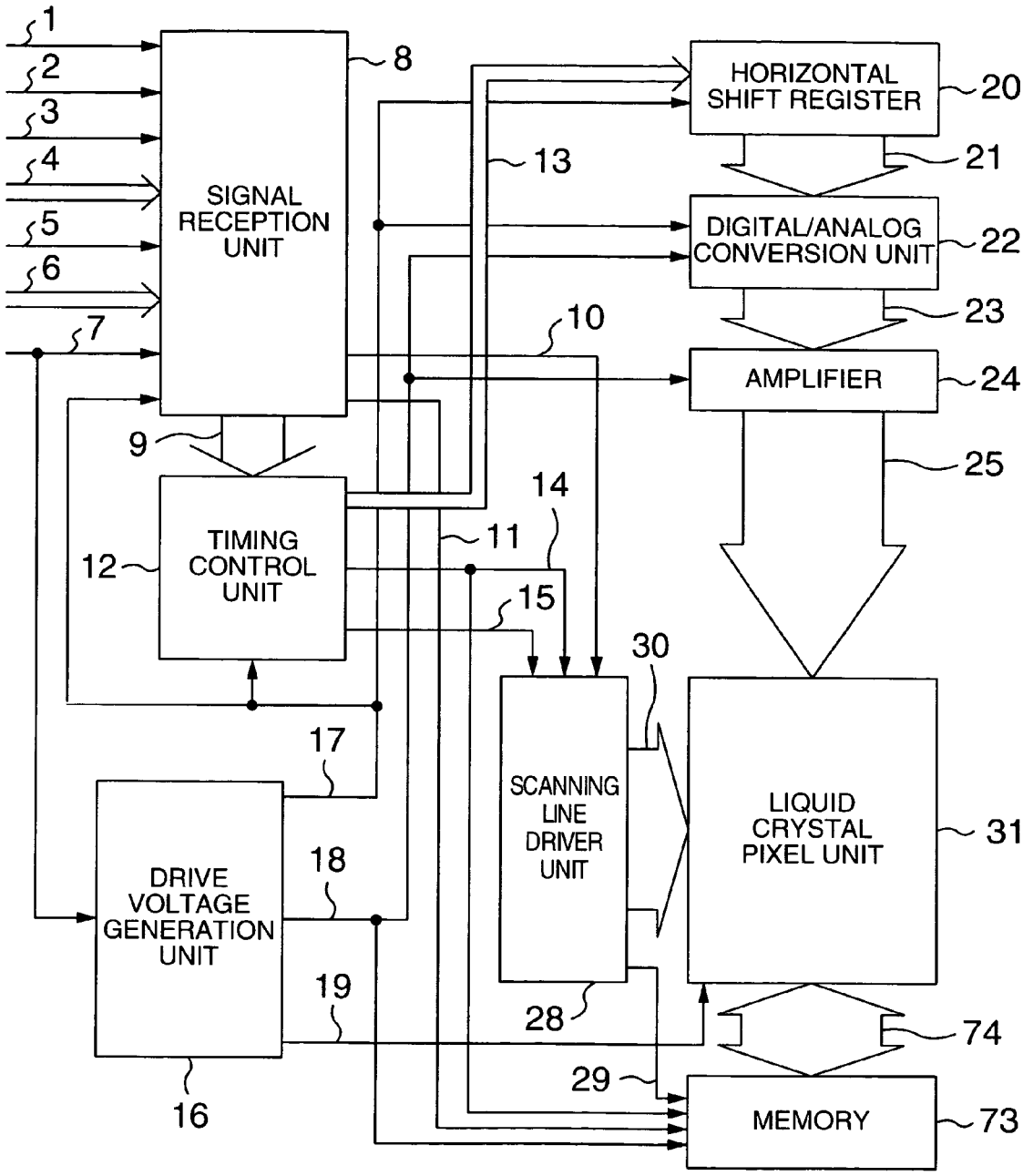
FIG. 9 is a block diagram showing a memory integrated type display device according to a second embodiment of the present invention.

FIG. 9 is a block diagram showing the structure of a memory integrated type display device according to another embodiment of the invention. In FIG. 9, components represented by identical reference numerals to those shown in FIG. 1 are equivalent to those shown in FIG. 1. Reference numeral 73 represents a memory connected to the back stage of the liquid crystal pixel unit, and reference numeral 74 represents memory read/write data. As different from the first embodiment, the memory 73 is not connected between the amplifier 24 and liquid crystal pixel unit 31, but is connected to the back stage of the liquid crystal pixel unit 31 via data lines of the liquid crystal pixel unit 31. The memory control is quite the same as that of the first embodiment. According to the second embodiment, in addition to the effects similar to the first embodiment, data stored in the memory can be used easily as the display data of another liquid crystal pixel unit, e.g., a subsidiary display screen of a portable telephone.

Third Embodiment.

The third embodiment of the present invention will be described in detail with reference to the drawing.

Figure 10:
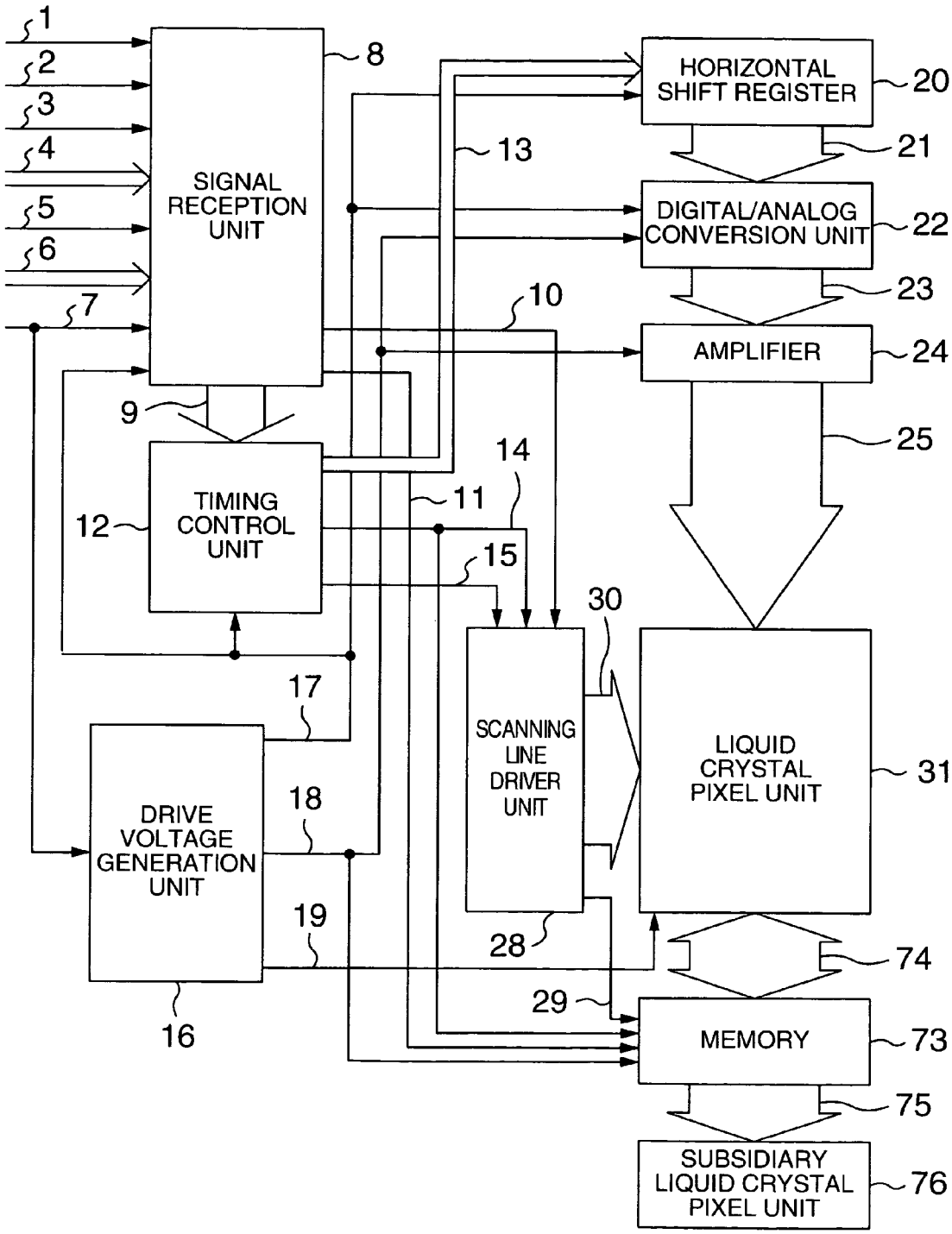
FIG. 10 is a block diagram showing a memory integrated type display device according to a third embodiment of the present invention.

FIG. 10 is a block diagram showing the structure of a memory integrated display device according to the third embodiment of the invention.

In FIG. 10, components represented by identical reference numerals to those shown in FIG. 1 are equivalent to those shown in FIG. 1, and the component represented by the identical reference numeral to that shown in FIG. 9 is equivalent to that shown in FIG. 9. Reference numeral 75 represents memory read data for a subsidiary display screen, and reference numeral 76 represents a subsidiary liquid crystal pixel unit. As different from the first and second embodiments, data stored in the memory 73 can be used as the display data not only for the liquid crystal pixel unit 31 but also for the subsidiary liquid crystal pixel unit 76. The data storage operation of the memory 73 is similar to that of the first and second embodiments.

Figure 11:
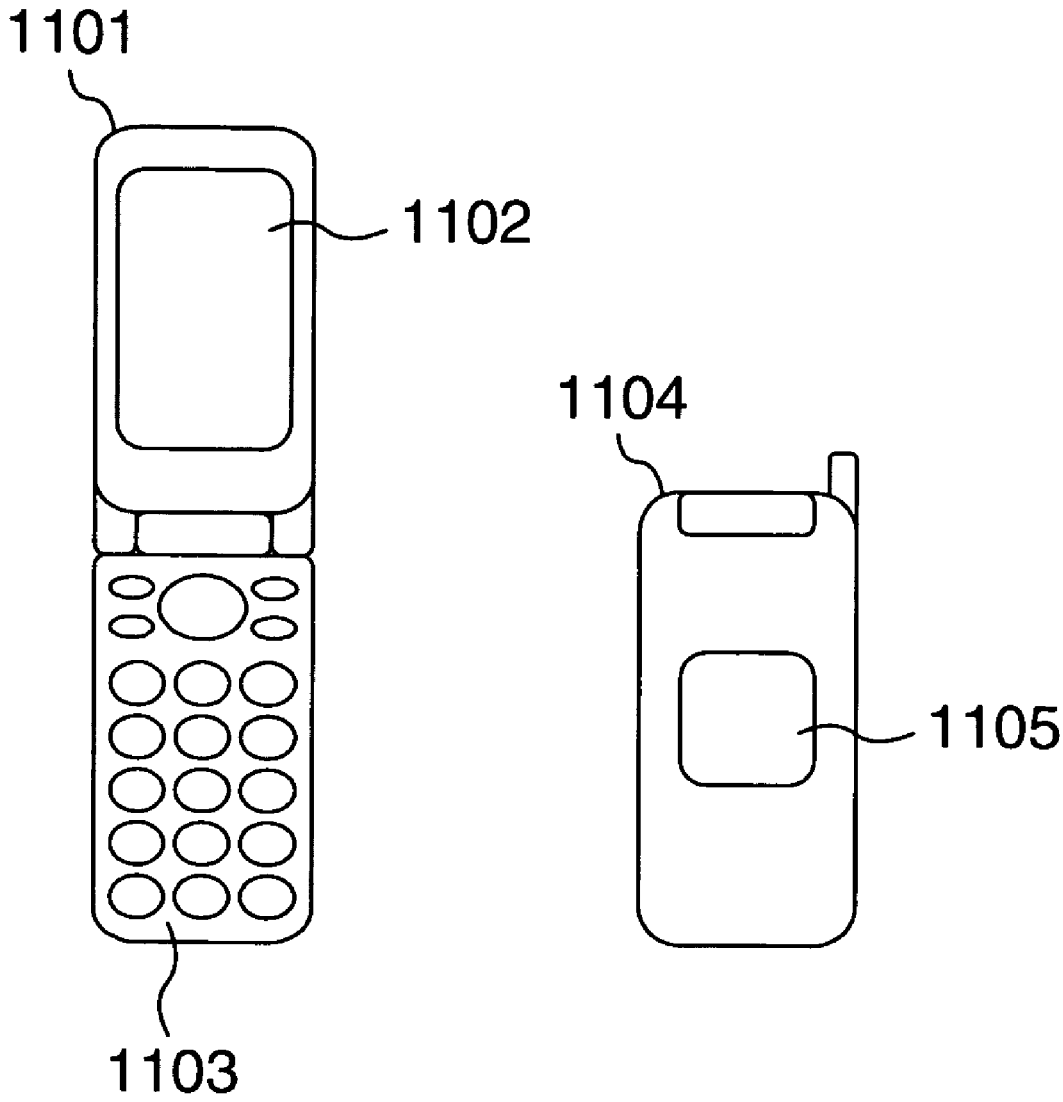
FIG. 11 shows an illustration of an application example of the memory integrated type display device of the third embodiment.

FIG. 11 shows an illustration of an application of the third embodiment of the present invention.

In FIG. 11, reference numeral 1101 represents a portable telephone of a fold type when it is opened, reference numeral 1102 represents a main display screen, reference numeral 1103 represents an operation unit, reference numeral 1104 represents the portable telephone of the fold type when it is closed, and reference numeral 1105 represents a subsidiary display screen. Display data is displayed on the main display screen 1102 and not displayed on the subsidiary display screen 1105, when the portable telephone of the fold type is opened. Conversely, when the portable telephone of the fold type is closed, data read from the memory 73 is displayed on the subsidiary display screen 1105 in the "partial mode" and not displayed on the main display screen 1102. The subsidiary display screen 1105 may perform the whole screen display or a partial screen display in a limited display area in a limited "partial mode".

According to the present invention, an address control circuit for a memory mounted on a glass substrate is not necessary. The present invention provides the effect that a low consumption power mode of a portable telephone can be realized while simplifying the peripheral circuits of a low temperature polysilicon liquid crystal display device.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A display device comprising:

a plurality of display elements disposed in a matrix shape;

a data line drive circuit for applying a drive voltage to each of data lines of said plurality of display elements;

a memory for storing display data; and a scanning line drive circuit for selecting said display element to be driven, wherein said memory is electrically connected between said data line drive circuit and said plurality of display elements disposed in the matrix shape;

wherein said memory includes memory cells disposed in a matrix shape, said memory cells having a capacity which corresponds to display data of n-columns×m-rows where n and m are integers equal to or greater than 2, wherein said memory is configured to write the display data in said memory cell or read the display data from said memory cell synchronously with a timing at which said scanning line drive circuit selects said display elements sequentially, and wherein said n corresponds to the number of the columns of the plurality of display elements disposed in a matrix shape, and said integer m is smaller than the number of the rows of the plurality of display elements disposed in a matrix shape.

2. A display device comprising:

a plurality of display elements disposed in a matrix shape;

a data line drive circuit for applying a drive voltage to each of data lines of said plurality of display elements;

a memory for storing display data; and a scanning line drive circuit for selecting said display element to be driven, wherein said memory is electrically connected between said data line drive circuit and said plurality of display elements disposed in the matrix shape, wherein said memory includes memory cells disposed in a matrix shape, said memory cells having a capacity which corresponds to display data of n-columns×m-rows where n and m are integers equal to or greater than 2, wherein said memory is configured to write the display data in said memory cell or read the display data from said memory cell synchronously with a timing at which said scanning line drive circuit selects said display elements sequentially, wherein said memory has a capacity capable of assigning one bit to each of pixels corresponding to a portion of said plurality of display elements disposed in the matrix shape, and wherein said one bit indicates whether said display data is larger or smaller than a predetermined threshold value.

3. A display device according to claim 1, wherein said memory includes a memory scanning shift register for scanning horizontal lines of said memory.

4. A display device according to claim 1, wherein said memory controls display data read/write relative to each memory cell and switches the display data, in accordance with an operation mode signal.

5. A display device according to claim 3, wherein said scanning line drive circuit includes a circuit for generating a memory vertical start pulse to be supplied to said memory scanning shift register.

6. A display device according to claim 1, wherein display data for a portion including a plurality of lines which is a portion among the plurality of display elements disposed in a matrix shape are stored in said memory, and said display data read from said memory are displayed in place of display data inputted from an external.

7. A display device according to claim 1, wherein said memory operates to write display data into said memory cell or read the display data from said memory cell synchronously with a timing at which said scanning line drive circuit selects said display elements sequentially, said display data corresponding to a portion of a plurality of lines which is a portion among the plurality of display elements disposed in a matrix shape.

8. A display device according to claim 1, wherein said memory operates to start writing of display data into said memory cell or reading of the display data from said memory cell when a position selected by a pulse signal set by which said scanning line drive circuit selects said display elements sequentially matches position information indicating a portion among the plurality of display elements disposed in a matrix shape.

9. A display device according to claim 1, wherein said memory operates to write said display data into said memory cell or read the same from said memory cell, according to a first pulse signal set; said first pulse signal set being started to output when a selection position selected by a second pulse signal set matches position information indicating a portion among the plurality of display elements disposed in a matrix shape; and said second pulse signal set being a signal set by which said scanning line drive circuit selects said display elements sequentially.

10. A display device according to claim 1, wherein said device includes a first mode of displaying said display data without writing the display data into said memory and reading the display data from said memory;

a second mode of writing the display data into said memory; and a third mode of displaying display data read from said memory;

in said second mode, said memory operating to write display data into said memory cell according to position information indicating a portion among the plurality of display elements disposed in a matrix shape, said display data being one corresponding to said portion; and in said third mode, said memory operating to read the display data corresponding to said portion from said memory cell according to said position information to output the read display data to said data line drive circuit.

11. A display device comprising:

a pixel unit having a plurality of display elements disposed on a glass substrate;

an amplifier for amplifying display data supplied from an external; and a memory disposed on said glass substrate for storing display data amplified by said amplifier;

wherein said memory includes memory cells disposed in a matrix shape, said memory cells having a capacity which corresponds to display data of n-columns×m-rows where n and m are integers equal to or greater than 2, wherein said memory is configured to write the display data in said memory cell or read the display data from said memory cell synchronously with a timing at which said scanning line drive circuit selects said display elements sequentially, and wherein said n corresponds to the number of the columns of the plurality of display elements disposed in a matrix shape, and said integer m is smaller than the number of the rows of the plurality of display elements disposed in a matrix shape.

12. A display device according to claim 11, wherein said memory has a capacity capable of assigning one bit to each of pixels corresponding to a portion of said plurality of display elements disposed in the matrix shape.

13. A display device according to claim 11, wherein said memory includes a memory scanning shift register for scanning horizontal lines of said memory.

14. A display device according to claim 13, wherein a scanning line drive circuit of the display device includes a circuit for generating a memory vertical start pulse to be supplied to said memory scanning shift register.

15. A display device according to claim 11, wherein said memory includes a control circuit for display data relative to said pixel unit, said control circuit controlling display data read/write relative to each memory cell and switches the display data, in accordance with an operation mode signal.

16. A display device according to claim 11, wherein display data for a portion including a plurality of lines which is a portion among the plurality of display elements disposed in a matrix shape are stored in said memory, and said display data read from said memory are displayed in place of display data inputted from an external.

17. A display device according to claim 11, wherein said memory operates to write display data into said memory cell or read the display data from said memory cell synchronously with a timing at which said scanning line drive circuit selects said display elements sequentially, said display data corresponding to a portion of a plurality of lines which is a portion among the plurality of display elements disposed in a matrix shape.

18. A display device according to claim 11, wherein said memory operates to start writing of display data into said memory cell or reading of the display data from said memory cell when a position selected by a pulse signal set by which said scanning line drive circuit selects said display elements sequentially matches position information indicating a portion among the plurality of display elements disposed in a matrix shape.

19. A display device according to claim 11, wherein said memory operates to write said display data into said memory cell or read the same from said memory cell, according to a first pulse signal set;

said first pulse signal set being started to output when a selection position selected by a second pulse signal set matches position information indicating a portion among the plurality of display elements disposed in a matrix shape; and said second pulse signal set being a signal set by which said scanning line drive circuit selects said display elements sequentially.

20. A display device according to claim 11, wherein said device includes a first mode of displaying said display data without writing the display data into said memory and reading the display data from said memory;

a second mode of writing the display data into said memory; and a third mode of displaying display data read from said memory;

in said second mode, said memory operating to write display data into said memory cell according to position information indicating a portion among the plurality of display elements disposed in a matrix shape, said display data being one corresponding to said portion; and in said third mode, said memory operating to read the display data corresponding to said portion from said memory cell according to said position information to output the read display data to said data line drive circuit.

21. A display device, comprising:

a pixel unit having a plurality of display elements disposed on a glass substrate;

an amplifier for amplifying display data supplied from an external; and a memory disposed on said glass substrate for storing display data amplified by said amplifier;

wherein said memory includes memory cells disposed in a matrix shape, said memory cells having a capacity which corresponds to display data of n-columns×m-rows where n and m are integers equal to or greater than 2; and wherein said memory is configured to write the display data in said memory cell or read the display data from said memory cell synchronously with a timing at which said scanning line drive circuit selects said display elements sequentially, wherein said memory has a capacity capable of assigning one bit to each of pixels corresponding to a portion of said plurality of display elements disposed in the matrix shape, and wherein said one bit indicates whether said display data is larger or smaller than a predetermined threshold value.

* * * * *